United States Patent [19]

Stoyanoff

[11] Patent Number: 4,852,909

[45] Date of Patent: Aug. 1, 1989

[54] STORAGE RECEPTACLE ADAPTED FOR FACILE CONTENT REFERENCE

[75] Inventor: Louis J. Stoyanoff, Pacific Palisades, Calif.

[73] Assignee: Academic Products, Inc., Pacoima, Calif.

[21] Appl. No.: 77,897

[22] Filed: Jul. 27, 1987

[51] Int. Cl.[4] ..... A47B 23/04; A47B 97/04; A47B 97/06; E05D 3/00

[52] U.S. Cl. ..... 281/33; 248/444; 248/447; 16/386

[58] Field of Search ..... 281/32, 24, 33, 45, 281/48, 49, 50, 34; 206/424; 248/309.2, 441.1, 444, 445, 446, 447, 454, 457, 460, 462

[56] References Cited

U.S. PATENT DOCUMENTS

| | | | |
|---|---|---|---|
| 1,720,607 | 7/1929 | Reed | 281/33 |
| 2,014,267 | 9/1935 | Sherman | 248/447 |
| 2,093,160 | 9/1937 | Steinthal | 281/33 |
| 2,178,903 | 11/1939 | Cole | 281/33 |
| 3,652,051 | 3/1972 | McFarlane | 248/444 |
| 4,184,725 | 1/1980 | Spangler | 248/447 |
| 4,420,270 | 12/1983 | Rossello | 281/33 |
| 4,552,479 | 11/1985 | Nickow et al. | 281/33 |
| 4,576,497 | 3/1986 | Beleckis | 281/33 |
| 4,677,707 | 7/1987 | Holler | 16/386 |

*Primary Examiner*—Frank T. Yost
*Assistant Examiner*—Paul M. Heyrana, Sr.
*Attorney, Agent, or Firm*—Kalish & Gilster

[57] ABSTRACT

A portable receptacle for documents and the like having opposed cover members each being pivotally engaged along confronting sides to an intervening spine. A ring binder is provided on the normally inner face of one cover proximate the spine. Wall-forming members are integral with the other cover member and projecting from the inner face thereof proximate opposed ends and the spine-remote side thereof for abutting the corresponding edge portions of the one cover member when the receptacle is in closed condition whereby the same is of general box-like character. A pair of support members are carried on said other cover member and being pivotally connected to spaced-apart locations on the wall-forming members at the opposite end edges of the other cover member for developing parallel pivot axes extending lengthwise of the support members. Each of said members having a side edge-forming angle of less than 90° with the proximate end of the related support member whereby when said support members are swung into operative position the same will support the receptacle in opened condition at a like angle to a convenient support surface.

12 Claims, 2 Drawing Sheets

STORAGE RECEPTACLE ADAPTED FOR FACILE CONTENT REFERENCE

FIELD OF INVENTION

This invention relates in general to storage receptacles and, more particularly, to a receptacle peculiarly constructed to safeguard the contents thereof as well as to permit ease of reference to the same.

BACKGROUND OF THE INVENTION

Heretofore, numerous efforts have been undertaken to provide containers for storage of documents and related flat, sheet-like materials but invariably the locating and reviewing of any of the same therein has proved to be a rather tedious undertaking. In most instances, finding documents and the like stored in receptacles have customarily involved physical removal of the same from the storage receptacle for identification and study. Providing index markers on documents or other discrete stored items, or providing identifying expedients on folders or files therefor have been used in an attempt to reduce the laboriousness of the particular search within the related receptacles. But such have still required the withdrawal of the sought for material and transport of the same to a remote support.

Limited efforts have been made to resort to looseleaf binders or other document disengageable devices for mounting the stored items, but such have been provided generally in book like covers which leave the documents in an unprotected state in their marginal zones against environmental hazards. Furthermore, this expedient has proven deficient in that the container must be spread out on a suitable surface for content reference; with the reference disposition customarily being unsatisfactory for relatively long term purposes.

SUMMARY OF THE INVENTION

The present invention contemplates the provision of a box-like receptacle, in general book-simulative form, incorporating swingably mounted supports so as to permit disposition of the receptacle for facile reference at a preselected angle to the vertical and with the stored item sought being retained in fully accessible state as long as desired.

The present invention thus provides enclosed, fully content protectable storage for documents and related materials, including diskettes and the like, which are maintained against accidental shifting or displacement by means of a looseleaf binder arrangement.

Therefore, it is an object of the present invention to provide a storage receptacle of the general character stated which provides a total enclosure for the documents and the like for shielding same from the environment.

It is another object of the present invention to provide a receptacle of the character stated which embodies means for swingable attachment to the receptacle so that the same are retained against inadvertent loss, and are readily manipulated for receptacle support to permit selected accessibility to discrete storage items.

It is a still further object of the present invention to provide a receptacle of the character stated which incorporates swingably mounted means for supporting the receptacle when in opened condition and at a preselected angle to the vertical for convenience of the user in searching the contained material, as well as permitting presentation of the preselected items in a state for reference as long as desired.

It is another object of the present invention to provide a receptacle of the character stated which is compact and dimensioned for convenient storage disposition upon a support surface or within a drawer or carrying case; which is adapted when opened for presentation at a preselected angle for content manipulation and viewing in a comfortable manner; which may be fabricated of durable plastic for resisting damage through wear and heavy usage; which is extremely reliable in usage; which effectively guards the contents against inadvertent damage; and which is adapted for facile transportability.

DESCRIPTION OF THE PREFERRED EMBODIMENT

Figure 1:
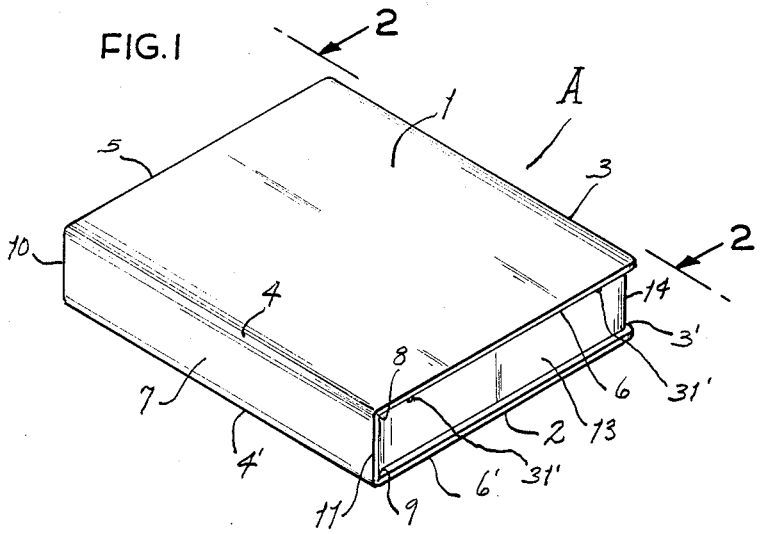
FIG. 1 is a perspective view of a receptacle constructed in accordance with and embodying the present invention showing the same in closed condition.

Referring now by reference characters to the drawings which illustrate the preferred embodiment of the present invention, A generally designates a receptacle of box-like, book simulative form comprising planar parallel, spaced-apart end covers 1,2, each being of flat rectangular configuration and having opposed, parallel outer and inner side edges 3,4 and 3',4', respectively, and parallel end edges 5,6 and 5',6', respectively. Interengaging covers 1,2 along their inner side edges 4,4' is a spine or side panel 7 which is integral with said covers 1,2 along respective lines of fold or weakness 8,9, respectively, so that covers 1,2 are readily relatively swingable or bendable thereabout. Panel 7 is provided with end edges 10,11 which are aligned with end edges 5,5', respectively, and 6,6', respectively, of covers 1,2.

Figure 2:
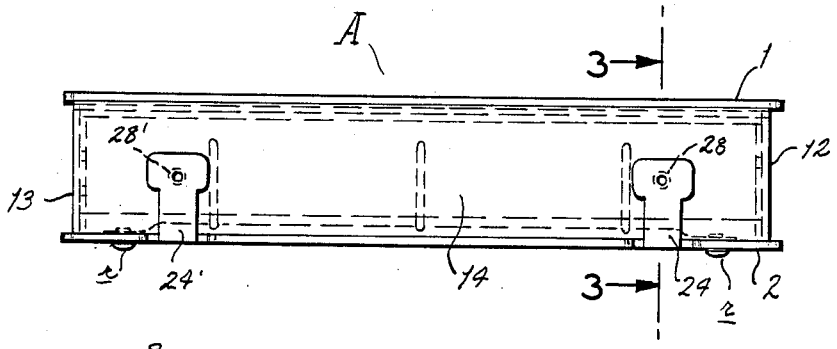
FIG. 2 is a side elevational view taken along the line 2—2 of FIG. 1.
Figure 3:
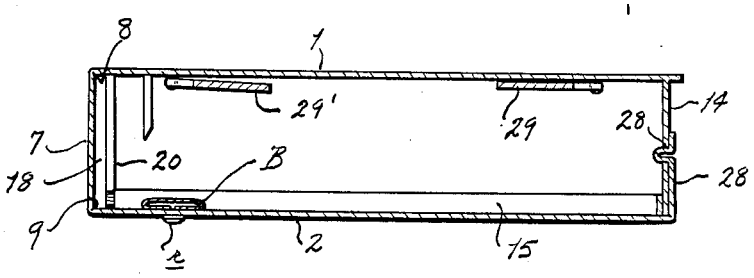
FIG. 3 is a vertical transverse sectional view taken on the line 3—3 of FIG. 2.

Upstanding from the normally inner face 1' of cover 1 are end walls 12,13 being limitedly spacedly inwardly of the adjacent end edge 5,6, respectively, of cover 1 and a side wall 14 inwardly spaced from adjacent edge 3; said side wall 14, and end walls 12,13 being of like height and of such extent that when cover 2 is in receptacle-closed relationship, abutting the exposed edges of said walls 12,13,14 the same will be in planar parallel relation to cover 1 (see FIG. 3). Cover 2 is provided along its end portions with relatively shallow, planar flanges 15,16, respectively, projecting from the inner face 2' thereof, planarwise perpendicular thereto, and which flanges in their spine-remote end portions are continuous with a flange of like height 17 extending therebetween and proximate edge 3' of cover 2. Thus, said flanges 15,16,17 extend from the inner face 2' of cover 2 but are located relatively slightly inwardly of the corresponding end walls 12,13 and side wall 14 of cover 1, respectively, so that when receptacle A is in closed condition said flanges 15,16,17 will be disposed immediately inwardly of said walls 12,13,14 of cover 1 to serve to rigidify the closed receptacle and inhibit any undesired relative shifting of cover 2 with respect to cover 1. Such relationship may be seen in FIGS. 2, 3 and 4.

Figure 4:
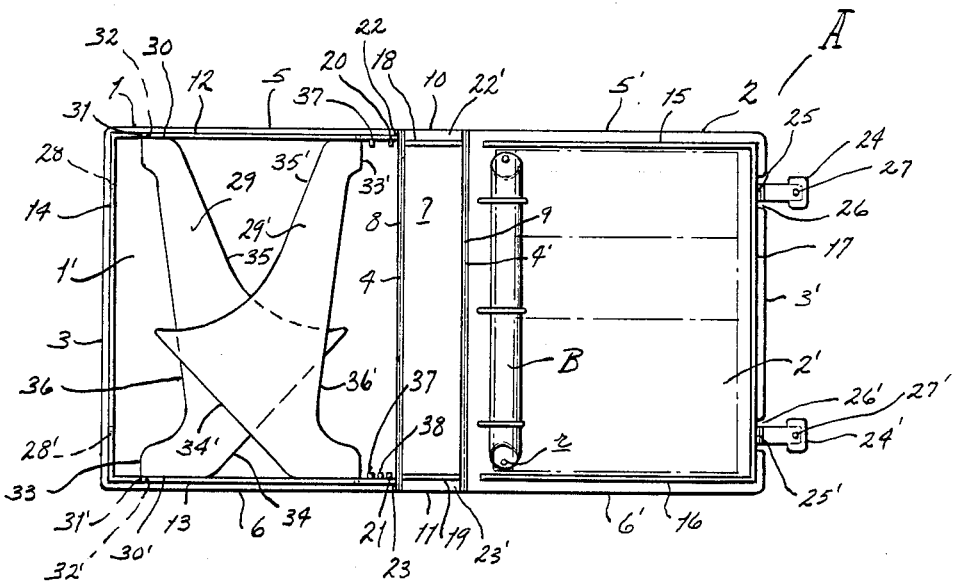
FIG. 4 is a top plan view of the receptacle in opened condition.

Provided on the normally inner face 7' of spine 7 proximate ends 10,11 thereof are transversely extending abutments 18,19, respectively, which are substantially aligned with flanges 15,16, respectively, when receptacle A is in opened condition as shown in FIG. 4. Thus, upon closure of receptacle A, said abutments 18,19 will be disposed immediately inwardly of the adjacent end portions of end walls 12,13, respectively, of cover 1 for contactive engagement with detents 20,21 projecting inwardly from the mutually confronting faces of end walls 12,13 whereby rigidification is accorded the joint developed between end walls 12,13 and spine 7 when receptacle A is in closed condition. It will be further observed that in such state the proximate end surfaces 22,23 of end walls 12,13 will be brought into abutting relation with spine 7 in the zones indicated at 22',23', respectively, between abutments 18,19 and the adjacent end edge of spine 7, respectively.

It will be seen that by reason of the unique relationship of walls 12,13,14 formed with cover 1; the flanges 15,16,17 of cover 2 and abutments 18,19 of spine 7, receptacle A will be assured of structural integrity when in closed condition whereby relative disconcerted shifting of the components of receptacle A is inhibited. Thus, by virtue of this novel construction receptacle A is adapted for construction in a relatively high volume, low cost manner, being suitable for fabrication from high impact, strong plastics, such as, for instance, polypropylene, and with the components being relatively thin so that receptacle A is of minimal weight and, thus, designed for ease of transportability by an individual who could handle receptacle A in a manner similar to that accorded a book. Furthermore, by reason of being adapted for production from such plastic materials, lines of weakness 8,9 provide hinges which are reliable in usage and which are resistant to damage through wear, despite long term, highly frequent usage.

Provided on cover 2 at spaced-apart locations along side edge 3' is a pair of locking tabs 24,24' which are integral with cover 2 along lines of weakness or bendability 25,25', respectively, located within recesses 26,26' provided in said edge 3'. By said lines of weakness 25,25', said tabs are bendable from a normal position substantially coplanar with cover 2 when the latter is in open state (FIG. 4) through an angle of 90° when cover 2 is in closed condition for presenting locking pins 27,27' carried in the portions of said tabs 24,24' remote from side edge 3' for reception within complementary openings 28,28' provided in side wall 3. By such relationship, receptacle A is securely latched into closed condition (see FIGS. 2 and 3) and, thus, presents a secure depository, fully protective of the contents thereof from displacement, as well as from any damage or injury that might be occasioned by external agents or forces, or environmental conditions.

Secured upon inner face 2' of cover 2, proximate side edge 4', and extending between flanges 15,16 immediately adjacent the spine-proximate ends thereof is a multi-ring binder B being of conventional construction and suitably secured to said cover 2 as by rivets r. As shown in the drawings, binder B is of the three-ring type but may have lesser or more rings as desired as binder B does not per se form a part of the present invention.

Provided for supporting receptacle A in an open state for ease of accessibility and reference to the material carried upon binder B is a pair of cooperating standards 29,29' of easel-forming character. As said standards 29,29' are of like construction, description will be restricted to merely one of the same for purposes of brevity of disclosure.

Figure 5:
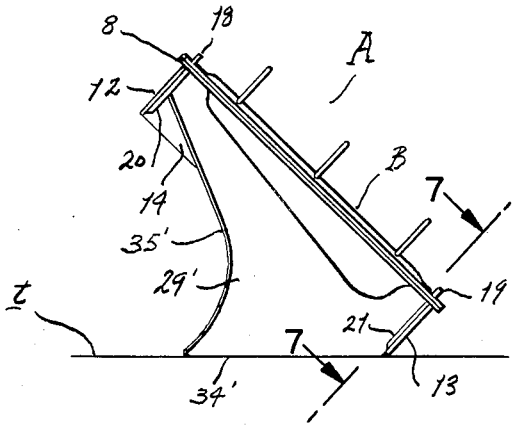
FIG. 5 is a side view illustrating the receptacle in opened condition and as presented by easel-forming supports.

With reference to FIGS. 4 and 5, it will be seen that each standard 29,29' is of flat plate form and contoured for utilization of the least amount of material of construction consonant with effective functionality. Each standard 29,29' incorporates opposed, parallel, rectilinear end edges 30,30' which are disposed immediately adjacent the proximate inner face portions of end walls 12,13, respectively, of cover 1 but being sufficiently spaced therefrom so as to prevent any interference of movement of end edges 30,30' relative to said end walls 12,13, respectively, for purposes evident hereinbelow. Said end edges 30,30' integrally embody aligned pivot pins 31,31', respectively, which project axially normal from said edges for extension into bearing-forming openings 32,32' formed in end walls 12,13, respectively, adjacent inner face 1', whereby said standards 29, 29' are each swingable about the axis developed by the related pins 31,31' which axis is parallel to the longitudinal axis of cover 1.

Said pivot axes are located along the inner edge portions 33,33' of the associated standards 29,29', respectively. It will be seen that standards 29,29' are in relatively reverse relationship whereby inner edge 33 of standard 29 is located proximate cover side edge 3, inwardly of wall 14 and the inner edge 33' of standard 29' is presented proximate side edge 4, whereby the respective pivot axes are parallel, but spaced-apart a distance comparable to the major extent of walls 12,13. The inner edge 33,33' of each standard 29,29' may be cut away, as at 36,36' throughout a substantial portion of the lengths thereof for material reduction as well as to provide minimal contact with cover inner face 1' as standards 29,29' are swung about the respective pivot axis thereof.

End edge 30' of each standard 29,29' in the portion thereof remote from the associated pins 31' is continuous with a rectilinear side edge 34,34' which forms an angle with the proximate end edge 30' of less than 90° and preferably in the vicinity of 45°. The ends of side edges 34,34' remote from proximate end edge 30' are interconnected with the related standard end edge 30 through a bridging edge 35,35', respectively, which may be of any suitable configuration but is shown as being of substantially arcuate form for material reduction purposes.

Figure 7:
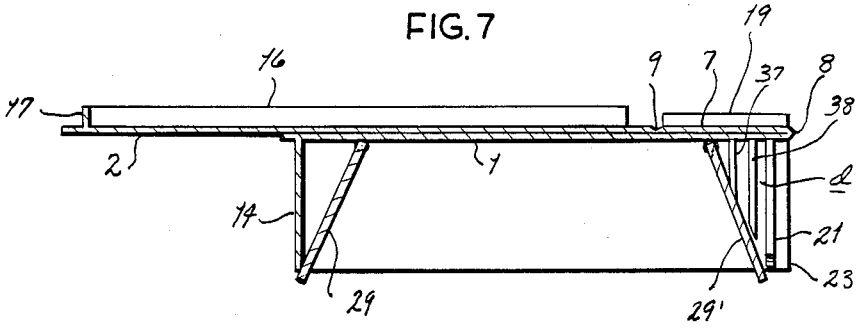
FIG. 7 is a vertical transverse sectional view taken on the line 7—7 of FIG. 5.

With reference now being made to FIG. 4, it will be seen that standards 29,29' when in inoperative position will be disposed in mutually overlying relationship upon or against cover inner face 1'. Since the pivot axes of standards 29,29' are within the same plane either standard 29 or 29' may be proximate cover inner face 1' and the other in superimposed position. Thus, the same by virtue of their relative thinness and configuration will be in non-interferring disposition when in such position of disuse and utilize but minimal space. When said standards 29,29' are swung into operative position so that the same move away from each other into the position shown in FIG. 7, it will be seen that such movement of standard 29 will be terminated by abutment against wall 14 spacedly from its pivot axis and with side edge 34 being presented for engaging a support surface, such as a table top t or any other convenient surface. The swinging movement of standard 29' from inoperative position is terminated by abutment against a detent d which is constituted of a plurality of ribs 37,38 integrally formed on the inner face of walls 12,13 immediately adjacent spine 7. It will be observed that with respect to wall 12 only a rib 37 is requisite in view of the shallow character of the adjacent end of standard 29'. The ends of said ribs 37 and 38 are inclined (see FIG. 7) so as to effect firm detaining engagement with standard 29' to present same in outwardly flaring position corresponding to standard 29. Standards 29,29' provide a very sturdy support for receptacle A when disposed in position for content reference. Said standards 29,29' present a self-contained easel so that one is spared the necessity of seeking some extraneous object for holding receptacle A in a manner permitting facile review of the contents.

Figure 6:
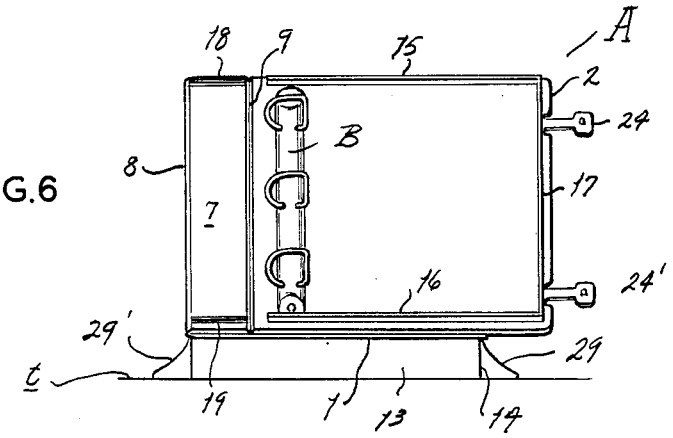
FIG. 6 is a front view of the receptacle in the condition shown in FIG. 5.

With particular reference to FIGS. 5 and 6, it will be seen that when receptacle A is in condition for content review, with standards 29,29' in supporting or operative position, cover 1 provides a base for spine 7 and cover 2 which are presented in overlying planar parallel relation to cover 1 and with spine 7 and cover 2 being coplanar. Line of weakness 8 accordingly permits spine 7 to swing from receptacle-closed condition through an angle of 270°.

As disposed in such manner, documents or transparent envelopes containing diskettes or other like flat information-containing material detachably engaged upon the rings of binder B may be easily swung about such rings for selected reviewing purposes. With cover 2 being firmly presented upon the underlying cover 1 as supported by standards 29,29', the same provides a sturdy surface for maintaining any selected material for reference in such condition for as long as the user may desire. Spine 7, as concurrently supported upon cover 1, provides an adequate base for the turned pages or documents so as to restrain same against downward swinging into contact with the support surface t.

In order to restore receptacle A to closed condition, standards 29,29' are sequentially swung into overlapping, inoperative position against the inner face 1' of cover 1 while cover 1 is being concurrently pivoted about line of weakness 8 into overlying relationship with respect to cover 2, during which travel spine 7 will swing about line of weakness 9 and terminate upon the abutment of the edges of walls 12,13,14 against the confronting edge portions 3',5',6', respectively. Thereupon, receptacle A is in completely closed state, with the documents or the like supported upon ring binder B being fully encased and, hence, thereby protected against any environmental hazards. Locking tabs 24,24' are swung into locking position with the respective pins 27,27' being received within the related keeper forming openings 28,28'

In this condition, receptacle A may be stored in any convenient disposition, that is, in upright state corresponding to the attitude of a book upon a shelf or other surface, or by reason of its compact nature being storable within a drawer; and by reason of the security which it provides against content displacement may be easily transported by an individual.

The angle of presentation of the receptacle when said standards 29,29' are in operative position will be determined by the angle between sides 34 of said standards 29,29' and the respective end edges 30' thereof. In the drawings this angle is approximately 45° and, thus, it will be seen in FIG. 5 that by reason of such angulation the plane of the documents will be at the same angle to the support surface t. Obviously, this angle may be varied depending upon preference but one in the neighborhood of 45° would appear to be most convenient.

What is claimed is:

1. A portable receptacle comprising first and second flat cover members, each of said cover members having parallel inner and outer side edges and parallel upper and lower end edges, a flat spine-forming member disposed between the confronting inner side edges of said first and second cover members, hinge means interengaging said spine and each of said cover members whereby the latter are swingable between spaced apart planar parallel or receptacle-closed relation and planar contiguous parallel relation in which latter position the spine is co-planar with said first cover member, an outer side wall-forming member and a pair of parallel end wall-forming members provided on said second cover member proximate the adjacent edges of said cover member and being in planar perpendicular relationship to said cover member for abutting on their cover member-remote portions said first cover member when the cover members are in spaced-apart, closed, or planar parallel relation, first and second support members carrier on said second cover member, said first support member being remote from said spine and said second support member being proximate said spine, said support members each having opposed ends, there being integral pivot pins provided at each of said ends for projection therebeyond, said pins being configured for reception in openings provided on the proximate end wall-forming member for swingably mounting said first and second support members with respect to the related end wall-forming members for movement of said support members between operative, generally diverging, extended position when said cover members are in planar contiguous parallel relation for engaging a support surface and inoperative, overlapping planar parallel relation to, and disposition against, said second cover member when said cover members are in spaced-apart planar parallel relation.

2. A portable receptacle as defined in claim 1 wherein the pivot pins on each support member are aligned to develop a pivot axis extending lengthwise of the associated support member and with the pivot axes of said support members being parallel.

3. A portable receptacle as defined in claim 1 wherein said first and second support members each have a maximum transverse extent greater than that of the wall-forming members for projection therebeyond when said support members are in operative position.

4. A portable receptacle as defined in claim 3 wherein detent means are provided on said second cover member proximate the spine-adjacent side edge thereof for abutting the proximate support member when the same is swung about its pivot axis for limiting swinging in the particular direction.

5. A portable receptacle as defined in claim 4 wherein each support member comprises a side edge formed at an angle of less than 90° to the proximate end of the related support member.

6. A portable receptacle as defined in claim 4 wherein each support member comprises a side edge spaced from the related pivot axis and being at an angle of about 45° to the proximate end of the related support member.

7. A portable receptacle as defined in claim 1 wherein said support members are of flat plate character having opposed ends and being dimensioned for flatwise overlapping disposition between the end wall-forming members of said second cover member when in inoperative position and being fully received within said second cover member when in such state.

8. A portable receptacle as defined in claim 1 wherein said support members are molded from pliable plastic to facilitate snap-in assembly of the pivot pins within the related openings.

9. A portable receptacle as defined in claim 1 wherein each support member divergingly extends equally beyond the related end wall-forming member when in operative position.

10. A portable receptacle as defined in claim 9 wherein the spine-remote wall-forming member limits the swinging of, and thereby determines the operative position of, the spine-remote or first support member.

11. A portable receptacle as defined in claim 10 wherein detent means are provided proximate the spine-adjacent end of each end wall-forming member of said second cover member for limiting the swinging of the spine-proximate or second support member and thereby determining the operative position of the same.

12. A portable receptacle as defined in claim 11 wherein said detent means comprises raised members integral with the associated wall-forming member.

* * * * *